US009309782B2

(12) United States Patent
Kareff et al.

(10) Patent No.: US 9,309,782 B2
(45) Date of Patent: Apr. 12, 2016

(54) FLAT BOTTOM DAMPER PIN FOR TURBINE BLADES

(75) Inventors: Spencer Aaron Kareff, Simpsonville, SC (US); Matthew Robert Piersall, Greenville, SC (US)

(73) Assignee: General Electric Company, Schenectady, NY (US)

( * ) Notice: Subject to any disclaimer, the term of this patent is extended or adjusted under 35 U.S.C. 154(b) by 909 days.

(21) Appl. No.: 13/616,129

(22) Filed: Sep. 14, 2012

(65) Prior Publication Data

US 2014/0079529 A1 Mar. 20, 2014

(51) Int. Cl.
*F01D 25/06* (2006.01)
*F01D 5/24* (2006.01)

(52) U.S. Cl.
CPC . *F01D 25/06* (2013.01); *F01D 5/24* (2013.01)

(58) Field of Classification Search
CPC ..... F01D 5/10; F01D 5/16; F01D 5/26; F01D 25/04; F01D 25/06; F01D 5/24
See application file for complete search history.

(56) References Cited

U.S. PATENT DOCUMENTS

| | | | | |
|---|---|---|---|---|
| 4,872,812 | A | 10/1989 | Hendley et al. | |
| 4,936,749 | A | 6/1990 | Arrao et al. | |
| 5,226,784 | A | 7/1993 | Mueller et al. | |
| 5,478,207 | A | 12/1995 | Stec | |
| 5,827,047 | A | 10/1998 | Gonsor et al. | |
| 6,171,058 | B1 | 1/2001 | Stec | |
| 6,354,803 | B1 | 3/2002 | Grover et al. | |
| 6,450,769 | B2 | 9/2002 | Szwedowicz | |
| 6,478,544 | B2 | 11/2002 | Brandl et al. | |
| 6,659,725 | B2 * | 12/2003 | Yeo et al. | 416/190 |
| 6,776,583 | B1 | 8/2004 | Wang et al. | |
| 6,827,551 | B1 * | 12/2004 | Duffy et al. | 415/119 |
| 6,851,932 | B2 | 2/2005 | Lagrange et al. | |
| 7,163,376 | B2 | 1/2007 | Itzel et al. | |
| 7,367,123 | B2 * | 5/2008 | Itzel et al. | 29/889.2 |
| 7,534,090 | B2 * | 5/2009 | Good et al. | 416/193 A |
| 7,731,482 | B2 | 6/2010 | Lagrange et al. | |
| 2004/0228731 | A1 * | 11/2004 | Lagrange et al. | 416/210 R |

* cited by examiner

*Primary Examiner* — Christopher Verdier
*Assistant Examiner* — Adam W Brown
(74) *Attorney, Agent, or Firm* — Ernest G. Cusick; Frank A. Landgraff

(57) ABSTRACT

A damper system for the buckets of a gas turbine engine. The damper system may include damper pins having a generally rounded top portion and a generally flat bottom portion along substantially the entire length thereof. The generally flat bottom portion may allow addition or removal of material to or from the pin in order to achieve an optimal dynamic weight ratio.

4 Claims, 4 Drawing Sheets

22
24
30
32
34
36
40

10
30
32
34
40
50
52
53
54
55
56
57
58
61
64
70
72

FLAT BOTTOM DAMPER PIN FOR TURBINE BLADES

TECHNICAL FIELD

The present application relates generally to gas turbines and more particularly relates to turbine buckets having a bucket damping system for minimizing bucket vibration.

BACKGROUND OF THE INVENTION

Gas turbines generally include a rotor with a number of circumferentially spaced blades or buckets mounted in adjacent positions extending radially about the periphery of a rotor wheel or disk. The buckets generally include an airfoil, a platform, a shank, a dovetail, and other elements. The dovetail is positional about the rotor and secured therein, generally by being slidably received in a complimentary configured recess in the rotor disk. The airfoils project into the gas path so as to convert the kinetic energy of the gas into rotational mechanical energy.

Each airfoil typically includes a convex side and a concave side. Likewise, the airfoil platform typically includes a leading edge and a trailing edge extending between the convex side and the concave side. A pair of generally axially spaced support ledges may be positioned on the convex side of the bucket. Likewise, an undercut may be positioned within the bucket platform from the leading edge to the trailing edge along the convex side on the other end. The undercut may include an angled surface that may extend the full axial length of the bucket.

During engine operation, vibrations may be introduced into the turbine buckets that can cause premature failure of the buckets if the vibrations are not adequately dissipated. In order to improve the high cycle fatigue life of a turbine bucket, vibration dampers are typically provided below the platforms to frictionally dissipate vibratory energy and reduce the corresponding amplitude of vibration during operation. The amount of vibration energy that is removed by the vibration damper is a function of the dynamic weight of the vibration damper and the reaction loads.

Although these known dampers may be largely adequate during typical operations, there is a desire to improve overall damper effectiveness. Prior attempts to accomplish damping of vibrations have included round damper pins, sheet metal flat dampers, or complex wedge shaped dampers. Often the true damper performance of these types of dampers is not known until the first engine test. At that time, the damper pocket geometry in the buckets is locked in by hard tooling. If the damper does not perform as expected, then an expensive tooling rework is required. Accordingly, there is desire to eliminate one or more of these aforementioned problems.

BRIEF DESCRIPTION OF THE INVENTION

The present disclosure thus describes a damping system for a turbine bucket of a gas turbine. The damping system may include a damper pin with a rounded top portion and a flat bottom portion. The damper pin flat bottom portion may have material added to it, or it may have material removed from it to achieve a desired dynamic weight ratio. If, upon initial engine testing, it is determined that the damper performance is not optimal, the damper pocket geometry need not be reworked, only the damper pin needs to be reworked.

These and other features of the present disclosure will become apparent to one of ordinary skill in the art upon review of the following detailed description when taken in conjunction with the drawings and the appended claims.

DETAILED DESCRIPTION

Figures 1, 2, 3:
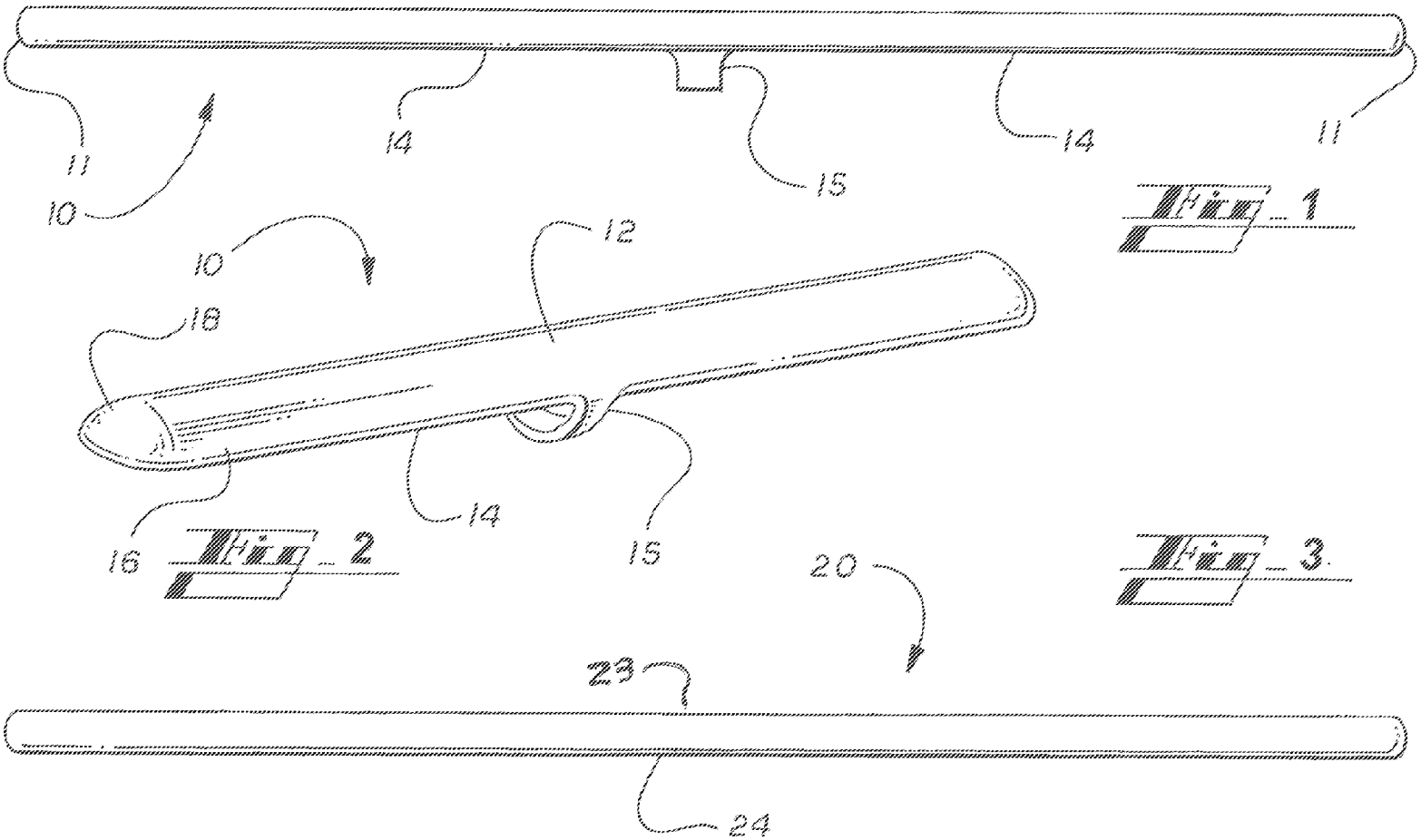
FIG. 1 is a frontal view of a flat bottom damper pin as described herein.
FIG. 2 is a perspective view of the flat bottom damper pin of FIG. 1.
FIG. 3 is a frontal view of an alternative embodiment of a flat bottom damper pin as described herein.

Referring now to the drawings, in which like numerals refer to like elements throughout the several views, FIGS. 1 and 2 illustrate a flat bottom damper pin, generally 10, as described herein. As illustrated, the damper pin 10 may have a generally rounded top portion 12. As further illustrated, the damper pin 10 may have a generally flat bottom portion 14 that may extend across substantially the entire length of the damper pin 10, but for a Murphy proofing tab 15. The Murphy proofing tab may assist in preventing the damper pin 10 from being installed in an incorrect orientation. The damper pin 10 may further include rounded or beveled edges 16 at the junction between the rounded top portion 12 and the flat bottom portion 14. A smooth transition point 18 may be further provided at the junction between both sides of the rounded top portion 12.

Figures 4, 5, 6, 7:
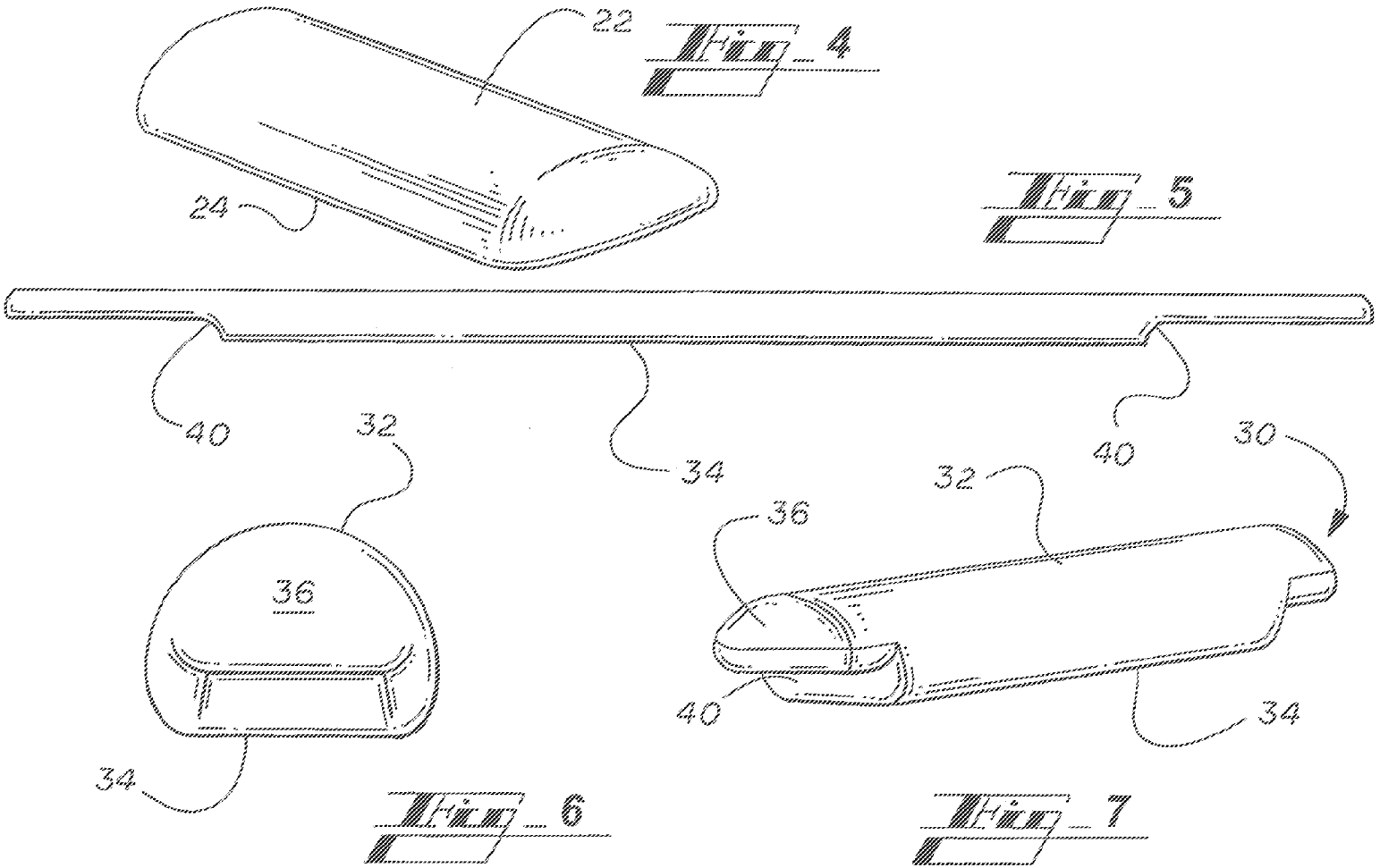
FIG. 4 is a perspective view of the flat bottom damper pin of FIG. 3.
FIG. 5 is a frontal view of an alternative embodiment of a flat bottom damper pin as described herein.
FIG. 6 is a side plan view of the flat bottom damper pin of FIG. 5.
FIG. 7 is a perspective view of the flat bottom damper pin of FIGS. 5 and 6.

An alternative embodiment of a flat bottom damper pin, generally 20, as described herein is illustrated in FIGS. 3 and 4. This damper pin 20 may also have a generally rounded top portion 22 and a generally flattened top portion 23. As further illustrated, the damper pin 20 may have a generally flat bottom portion 24 that may extend across the entire length of the damper pin 20. The damper pin 20 differs from the damper pin 10 of FIG. 1 primarily in the elimination of the Murphy proofing tab 15.

Yet another alternative embodiment of a flat bottom damper pin, generally 30, as described herein is illustrated in FIGS. 5-7. As illustrated, this damper pin 30 may have a fully rounded top portion 32 and a generally flat bottom portion 34 that may extend across the entire length of the bottom surface of the damper pin 30.

The damper pin 30 may include bossed ends 36 with bosses 40 provided along the underside of the damper pin 30, which shall be subsequently described.

As used herein, the term "substantially the entire length," with reference to a flat bottom, is intended to mean not only damper pins that have a flat bottom along their entire length, but also damper pins having a Murphy proofing tab disposed on the bottom of an otherwise flat-bottomed damper pin, and otherwise flat-bottomed damper pins having bosses on the bottom surface thereof and/or bossed ends extending from the damper pin.

Figures 8, 10, 11:
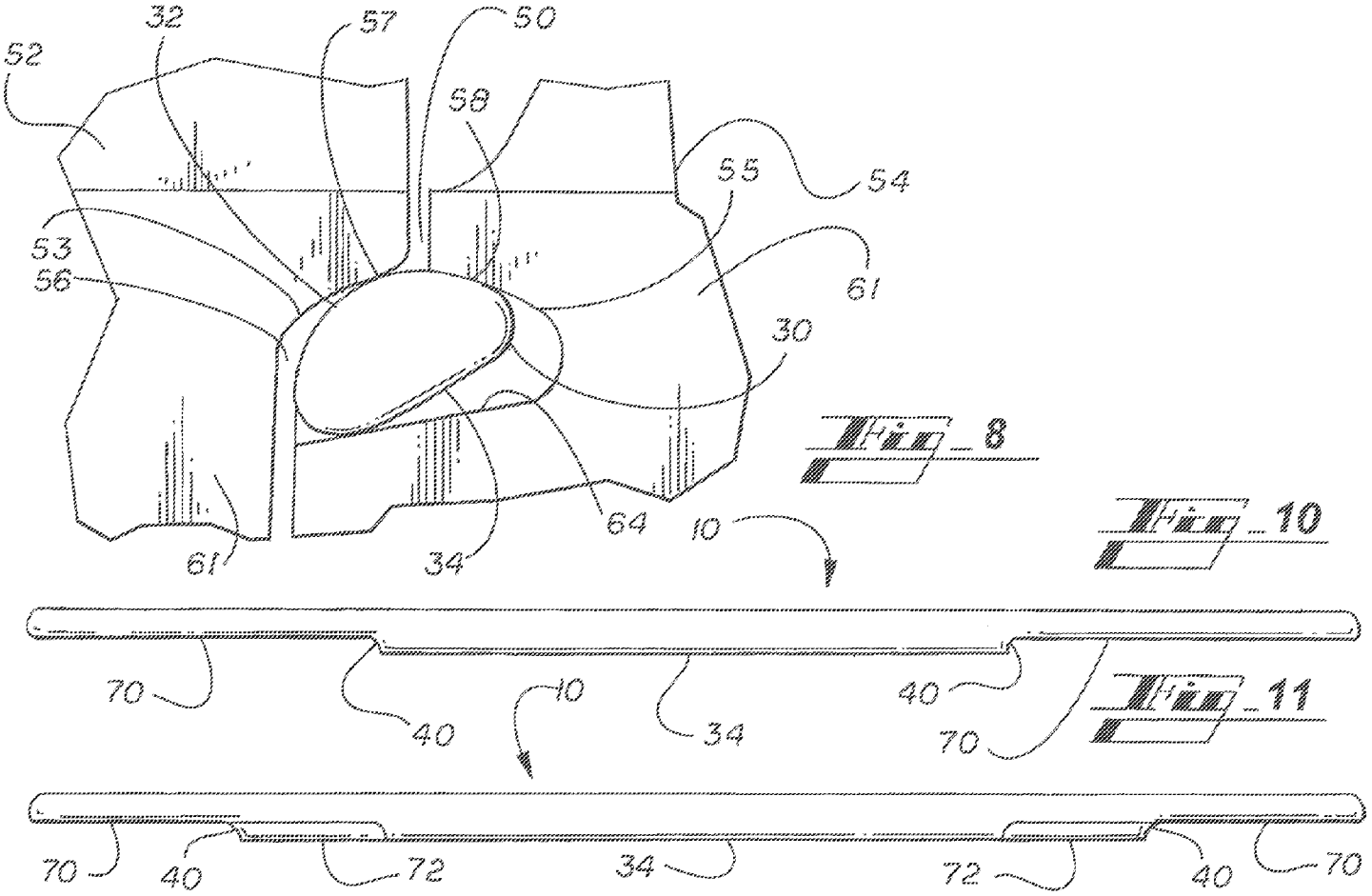
FIG. 8 is a side plan view of a bucket vibration damping system described herein, with a flat bottom damper pin such as that illustrated in FIGS. 5-7 positioned between two adjoining buckets.
FIG. 10 is a frontal view of an alternative embodiment of a flat bottom damper pin as described herein.
FIG. 11 is a frontal view of an alternative embodiment of a flat bottom damper pin as described herein.
Figure 9:
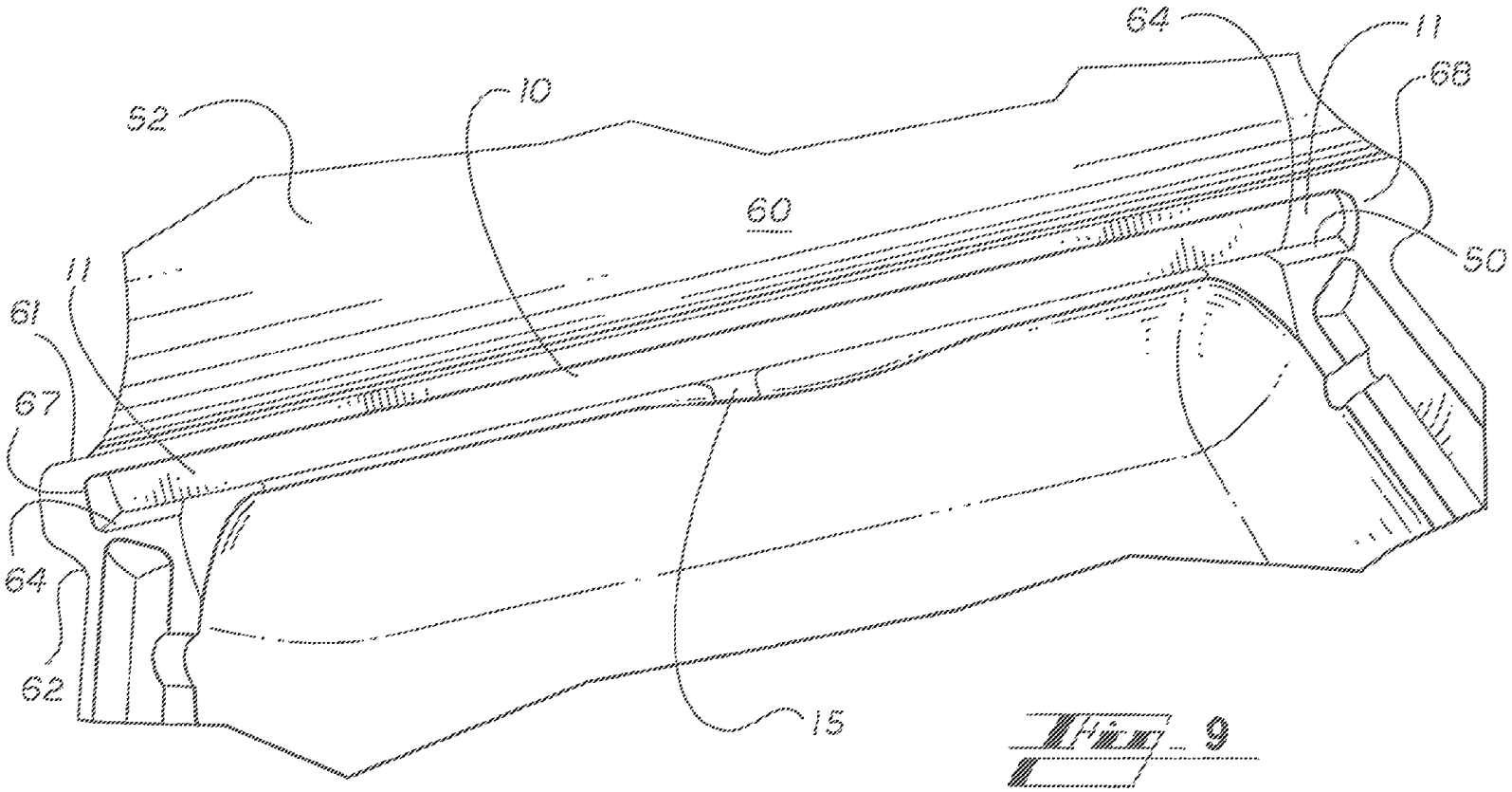
FIG. 9 is a frontal view of a bucket vibration damping system described herein, with a flat bottom damper pin such as that illustrated in FIGS. 1-2.

FIGS. 8 and 9 illustrate flat bottom damper pins as described herein installed in a bucket damper slot 50. The damper pin 30 illustrated in FIG. 8 is essentially the same as that illustrated in FIGS. 5-7. While the discussion of FIG. 8 thus relates primarily to damper pin 30, it will be appreciated that damper pins 10 and 20 of FIGS. 1-2 and 3-4, respectively, could be used interchangeably with the damper pin 30 illustrated in FIG. 8. As illustrated in FIG. 8, a bucket damper slot, 50, is created when two adjacent buckets, 52 and 54, are assembled into the turbine rotor. The adjacent buckets 52 and 54 may each have undercuts, 53 and 55, respectively that together form the bucket damper slot 50. The bucket damper slot 50 may be machined or cast within the platform 61 of the adjacent buckets 52 and 54. One or both adjacent buckets 52, 54 may include one or more support ledges 64, which may also be machined or cast within the platform 61. Other types of manufacturing techniques may be used herein. The flat bottom damper pins 10, 20, or 30 described herein may initially rest on the support ledge(s) 64 upon installation.

Prior to full speed rotation of the rotor, the damper pin 30, as illustrated in FIG. 8, may be displaced radially outwardly and at least partially off the support ledge(s) 64 by centrifugal force, causing engagement between the rounded top portion 32 of the damper pin 30 and the undercuts 53 and 55 of the adjacent buckets 52 and 54, respectively, thereby causing both buckets 52 and 54 to be engaged by the damper pin 30. As illustrated, the rounded top portion 32 may contact both undercuts, 53 and 55, at points 57, 58, in the bucket damper slot 50, enabled by virtue of the damper pins 10, 20, and 30 each having an at least partly rounded or arcuate top portion 32. Alternatively, only one of the two adjacent buckets 52, 54, may have an undercut, in which case the damper pin 30 may be substantially fully enclosed in an undercut in one of the two adjoining buckets, and may contact a flat face of the adjoining bucket, and the rounded top portion 32 of the damper pin 30 may contact the adjoining buckets prior to full-speed rotation of the rotor. As illustrated, there may be a radial clearance 56 between the damper pin 30 and the bucket 52, which clearance 56, at the assembled condition, should be such that hot binding will not occur, considering manufacturing and assembly tolerances and hot growths. The use of the flat bottom portion 34 may allow for fine tuning of the damper pin 30 if the first engine test reveals the damper pin 30 is not functioning optimally, in which case, addition of material to, or removal of material from, the flat bottom portion 34, for example by machining, may be done in order to achieve a desired and/or optimal dynamic weight ratio.

As seen in FIGS. 2, 4, and 6, the damper pins of the present disclosure may be generally symmetrical in cross section. This symmetry may be achieved, for example, by fabricating the pins from one that is initially round in cross section, and machining a portion of the pin, substantially along its entire length, with a flat bottom portion. It will be readily appreciated that creating a substantially flat bottom portion along substantially the entire length of any round pin will result in a pin of generally symmetrical cross section. Employing a damper pin that is symmetrical in cross section avoids the need for complicated wedge shapes and angles of the prior art, and may therefore allow for greater ease of manufacturability. Furthermore, the use of a symmetrical damper pin may permit the flat bottom portion to have material added to it, or be readily machined down to a desired dynamic weight ratio after initial installation and testing, and in combination with the rounded top portion, may permit the damper pin to seat properly in virtually any bucket damper slot geometry.

The damping weight of the damper pin disclosed herein may be optimized by analytical results or by test results. The result may be an ability to tune to a specific dynamic weight by adding or removing a given amount of material without changing the pocket geometry or the radius of the damper pin between adjacent contact points. By retaining the rounded top portion, i.e., the same arc of curvature at the contact points 57, 58, the bucket geometry does not need to change. The performance characteristics of the damper pin can be optimized by only changing the flat bottom portion through machining or other techniques to add or remove known amounts of material.

Referring now to FIG. 9, there is illustrated a damper pin 10, substantially as illustrated in FIGS. 1-2, installed in a bucket damper slot 50 of a bucket 52. The illustration of FIG. 9 is representative of one of a plurality of buckets that may be disposed about the periphery of a turbine rotor. While FIG. 9 illustrates installation of a damper pin 10 substantially as illustrated in FIGS. 1-2, it will be readily appreciated that alternative damper pin embodiments, such as those shown in FIGS. 3-7 and 10-11, may be used interchangeably with the damper pin 10 shown in FIG. 9. As illustrated, each bucket 52 of FIG. 9 includes an airfoil, generally 60 having a platform 61 and a shank 62 that merges with a dovetail (not shown) for installation in a dovetail slot in a rotor having a generally circular periphery (not shown). The ends 11 of the damper pin 10 may be supported in the bucket damper slot 50 on a pair of support ledges 64 disposed in the shank 62 of the bucket. Each of the damper pins 10, 20, and 30 have a generally elongate body, as illustrated, that when installed in the bucket damper slot 50, extends substantially from the forward end 67 of the bucket damper slot 50 to the aft end 68 of the bucket damper slot 50.

When a damper pin 30 such as illustrated in FIGS. 5-7 is employed, the damper pin 30 may include bosses 40 that are axially spaced closer together than the distance between the support ledges 64. The bosses 40 may assist in aligning the damper pin 30 within the bucket damper slot 50 and may prevent the damper pin 30 from being removed or falling from the bucket damper slot 50 in the axial direction upon installation.

Preferably, the shape of the damper pin ends 11 and bossed ends 36 and the bucket damper slot 50 are designed such that the damper pin 10 is able to seal and provide damping during operation.

As will now be appreciated, other shapes, configurations, and combinations for the flat bottom damper pins described herein may be used. For example, the damper pin may include bossed ends, and a Murphy proofing tab. Or, the damper pin may include bosses and no Murphy proofing tab. Other combinations are of course possible.

The present disclosure also provides a method of fabricating a flat bottom damper pin as disclosed herein. The method may comprise the steps of providing a pin having a rounded top portion, determining an optimal dynamic weight ratio for the pin in the bucket via analytical and past test experience, adding to or removing a portion of the pin material, such as by machining or other known methods to create a flat bottom portion along substantially the entire length of the pin, such that the weight of the damping pin following addition of material or elimination of the removed portion of the pin material corresponds to the predetermined dynamic weight ratio.

The method may further comprise the steps of installing the damper pin in a bucket damper slot of a gas turbine, performing an engine test on the gas turbine, determining from the engine test if the damper pin is performing at the optimal dynamic weight ratio, for example, by monitoring vibratory response levels, and if the damper pin is not performing at the optimal dynamic weight ratio, adding material to, or removing an additional portion of pin material from, the flat bottom surface along substantially the entire length thereof, maintaining a substantially flat surface along substantially the entire bottom surface of the pin.

As will now be appreciated, in practicing the disclosed method, the pin may initially be round in cross section along its length, and the flat bottom surface may be achieved by removing, for example by machining, abrading, grinding, etc., a quantity of material from the pin such that the weight of the resulting flat bottom pin corresponds to the desired optimal dynamic weight ratio. As will now also be readily appreciated, if the pin includes a Murphy proofing tab, or one or more bosses, the corresponding change in weight of the pin should be taken into account in determining the amount of material to add to or remove from the flat bottom portion in order to achieve the optimal dynamic weight ratio.

Turning now to FIGS. 10 and 11, there is illustrated another aspect of the present disclosure for adding or removing material from the damper pin 10 in order to achieve the optimal dynamic weight ratio. As illustrated in FIG. 10, the damper pin 10 may include flat lands 70 associated with the bosses 40. The optimal dynamic weight ratio of the damper pin 10 may be achieved by varying the length of the flat lands 70, for example, extending the length of the flat lands 70 by removing material, such as by machining, from the flat bottom portion 34 of the damper pin 10. As illustrated in FIG. 11, the optimal dynamic weight ratio of the damper pin 10 may be achieved by shortening the length of the flat lands 70 by adding material 72 to the flat lands 70, thereby adding weight to the damper pin 10. This added material 72 may be added, for example, by sintering, welding, or other known means.

This written description uses examples to disclose the invention, including the best mode, and also to enable any person of ordinary skill in the art to practice the invention, including making and using any devices or systems and performing any incorporated methods. The steps recited in the accompanying method claims need not be taken in the recited order, where other orders of conducting the steps to achieve the desired result would be readily apparent to those of ordinary skill in the art. The patentable scope of the invention is defined by the claims, and may include other examples that occur to those of ordinary skill in the art. Such other examples are intended to be within the scope of the claims if they have structural elements that do not differ from the literal language of the claims or if they include equivalent structural elements with insubstantial differences from the literal languages of the claims.

We claim:

1. A method of fabricating a damper pin for a bucket of a gas turbine, comprising the steps of:

a. providing a pin having a generally rounded top portion;

b. determining an optimal dynamic weight ratio for said pin in said bucket;

adding material to, or removing a portion of material from, said pin to create a generally flat bottom portion along substantially the entire length of said pin, the weight of said damping pin following addition or removal of said material corresponding to said dynamic weight ratio for said bucket, and the method further comprising the steps of c. installing said damper pin in a bucket damper slot of a gas turbine, d. performing an engine test on said gas turbine;

e. determining from said engine test if said damper pin is performing at said optimal dynamic weight ratio; and f. if said damper pin is not performing at said optimal dynamic weight ratio, adding or removing material to or from said flat bottom portion along substantially the entire length thereof, maintaining a substantially flat surface along substantially the entire length of said pin.

2. The method of claim 1 further comprising providing a Murphy proofing tab on said generally flat bottom portion.

3. The method of claim 1 further comprising providing bosses on said pin.

4. The method of claim 1 wherein the damper pins comprise lands, and the method further comprising changing lengths of the lands of said damper pin if said damper pin is not performing at said optimal dynamic weight ratio.

* * * * *